United States Patent [19]

Frey et al.

[11] 4,037,188

[45] July 19, 1977

[54] THRUST BUSHING FOR VARIABLE RESISTANCE CONTROL

[75] Inventors: Robert L. Frey; Lee R. George, both of Frankfort, Ind.

[73] Assignee: P. R. Mallory & Co., Inc., Indianapolis, Ind.

[21] Appl. No.: 598,171

[22] Filed: July 23, 1975

[51] Int. Cl.[2] ..... H01C 10/34

[52] U.S. Cl. ..... 338/174; 338/162

[58] Field of Search ..... 338/174, 202, 160, 162, 338/171, 184, 190, 192, 118, 128; 74/10 R, 10 A, 22 R, 22 A

[56] References Cited

U.S. PATENT DOCUMENTS

| | | | |
|---|---|---|---|
| 2,118,267 | 5/1938 | Richter | 338/174 X |
| 2,722,585 | 11/1955 | Mucher | 338/174 |
| 2,873,336 | 2/1959 | Tassara | 338/174 X |

*Primary Examiner*—C. L. Albritton

*Attorney, Agent, or Firm*—Hoffmann, Meyer & Coles

[57] ABSTRACT

A thrust bushing is trapped between a rotor and a bushing in which a shaft carrying the rotor is rotated to provide better torque control as the shaft is rotated.

2 Claims, 1 Drawing Figure

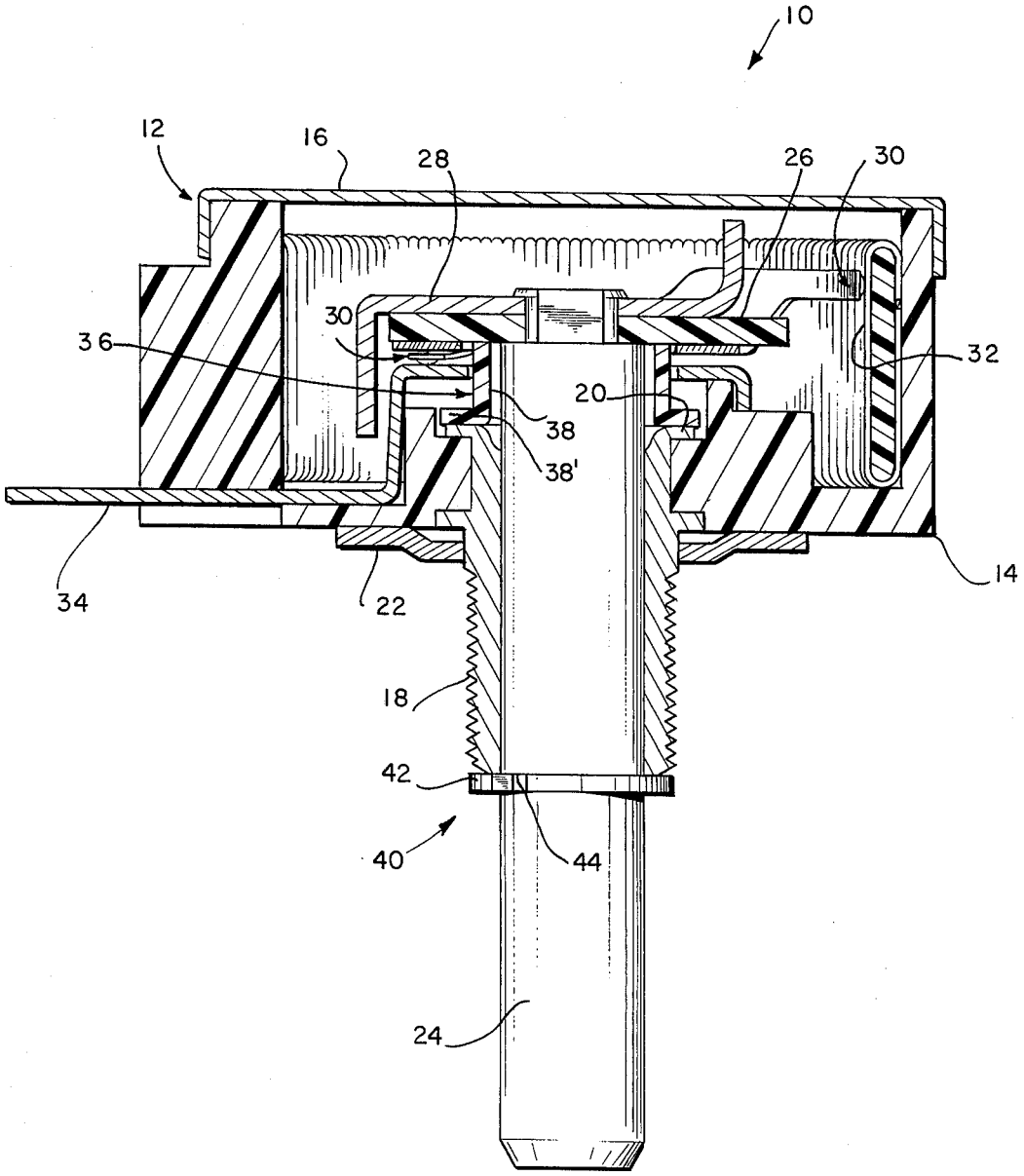
10
12
16
28
26
30
30
36
32
20
38
38'
34
22
14
18
42
40
44
24

THRUST BUSHING FOR VARIABLE RESISTANCE CONTROL

Generally speaking the present invention relates to an improvement in a variable resistance control wherein electrical contact means is carried by a rotor and rotates therewith while electrically bridging a resistance element and a collector within a housing, the rotor carried by a shaft rotating within and extending through a bushing, the bushing fixedly carried by the housing, the improvement comprising: a stop means carried by the shaft and engaging an end of the bushing, and a molded one piece thrust bushing surrounding the shaft and trapped between the rotor and an opposed end of the bushing.

The present invention pertains to a means of improving the manner in which a shaft and a rotor carried by the shaft rotate in a variable resistance control and more particularly to a means providing better torque control of the shaft as it rotates.

In variable resistance controls a shaft is rotated to turn a rotor, the rotor carrying electrical contacts to provide an electrical bridge between a resistance element and a common collector. Typically in such variable resistors a shaft, which carries a rotor, rotates within a bushing member, the bushing member being staked or otherwise carried by a housing for the control. There are many problems associated with such shaft arrangements such as: shaft rattle, maintaining close tolerances, dependable construction, and in general providing good torque control through a so-called "velvet touch" of the shaft.

Accordingly it is a feature of the invention to provide a variable resistance control having improved torque control of the control's rotating shaft. Another feature of the invention is the provision of a variable resistance control having a shaft rotating within a bushing, the shaft carrying a rotor, and a thrust bushing trapped between the bushing and the rotor. Still another feature of the invention is the provision of such a variable resistance control wherein there is further provided a stop means holding the shaft in a fixed position in relation to the bushing.

There and other features of the invention will become apparent from the following description taken in conjunction with the accompanying drawing in which the sole figure is a section of a variable resistance control embodying the features of the invention.

Referring to the drawing, there is shown a variable resistance control 10 embodying the principles of the invention. In general, the control includes a housing 12 comprised of a circular cup shaped member 14 and a cover 16 closing the same. A bushing 18 is fixedly carried by the cup shaped member 14 by staking the bushing to the member as at the lapped over portion 20 of the bushing. Further support for the bushing is provided by a spring washer 22.

Rotable within bushing 18 is a shaft 24. Shaft 24 carries a rotor 26, stop member 28, and electrical contact means 30 which electrically bridges a resistance element 32 and a common collector 34. Stop member 28 limits the rotation of the rotor and thus the shaft by engaging a detent (not shown) carried by the housing. Such controls and their elements are well known in the art. Also, as is well known, rotation of shaft 24 through a knob (not shown) causes a change in resistance as the electrical contact means rotates and engages the resistance element and the collector. Such change in resistance can be used to change the volume of a radio, for example.

According to the invention, better torque control or feel of the shafts rotation is accomplished by providing a thrust bushing 36 against which the rotor can rotate. In the illustrative embodiment thrust bushing 36 includes a molded plastic one piece hat washer 38 having a flange portion 38', the hat washer being trapped between the rotor and the lapped over portion 20 of bushing 18. Axial displacement of shaft 24 is prevented by stop means 40 which in the illustrative embodiment includes a C-ring 42 carried in a groove 44 of the shaft. Such prevention of shaft displacement insures a good tight fit of the hat washer 38 between the rotor and the lapped over portion 20 of bushing 18.

What is claimed is:

1. In a variable resistance control wherein electrical contact means is carried by a rotor and rotates therewith while electrically bridging a resistance element and a collector within a housing, said rotor carried by a shaft rotating within and extending through a bushing, said bushing fixedly carried by said housing, the improvement comprising:

a. stop means carried by said shaft and engaging an end of said bushing, and b. a molded one piece hat washer surrounding said shaft and trapped between said rotor and said bushing and having a flange engaging a lapped over portion of an opposed end of said bushing.

2. The improvement according to claim 1 wherein said stop means comprises a C-ring carried in a groove of said shaft.

* * * * *